US006304158B1

(12) United States Patent
Nishijima et al.

(10) Patent No.: US 6,304,158 B1
(45) Date of Patent: Oct. 16, 2001

(54) DIELECTRIC FILTER, COMPOSITE DIELECTRIC FILTER, ANTENNA DUPLEXER, AND COMMUNICATION APPARATUS

(75) Inventors: Shohachi Nishijima, Komatsu; Motoharu Hiroshima; Hideyuki Kato, both of Ishikawa-ken; Haruo Matsumoto, Kanazawa, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/391,825

(22) Filed: Sep. 8, 1999

(30) Foreign Application Priority Data

Sep. 8, 1998 (JP) ..... 10-253694

(51) Int. Cl.[7] ..... H01P 1/20; H01P 5/12
(52) U.S. Cl. ..... 333/206; 333/202; 333/134
(58) Field of Search ..... 333/202, 206, 333/134, 207

(56) References Cited

U.S. PATENT DOCUMENTS 5,489,882 * 2/1996 Ueno ..... 333/206
5,712,604 * 1/1998 Tada et al. ..... 333/202
5,870,006 * 2/1999 Tada et al. ..... 333/202
5,905,420 * 5/1999 Tsujiguchi et al. ..... 333/206
6,023,207 * 2/1999 Ito et al. ..... 333/206
6,163,237 * 12/2000 Toda et al. ..... 333/206

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

There is provided a dielectric filter, comprising: a plurality of resonance lines aligned in a dielectric block, in a dielectric subtrate or on a dielectric substrate; a plurality of input-output units respectively coupled to the plurality of resonance lines; at least one of the input-output units comprising a first external terminal capacitively coupled to one of the plurality of resonance lines, an external coupling line coupled to the one of the plurality of resonance lines to which the first external terminal is capacitively coupled, and a second external extending from an end of the external coupling line.

In the above dielectric filter, input and output of signals are performed in a two-terminal type or a balance type, without using a balun.

10 Claims, 11 Drawing Sheets

FIG. 12A
PRIOR ART
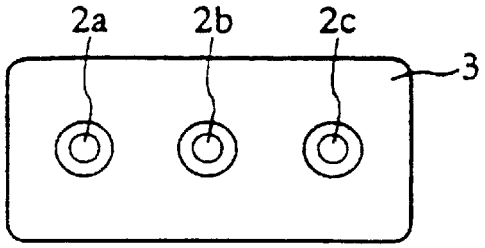
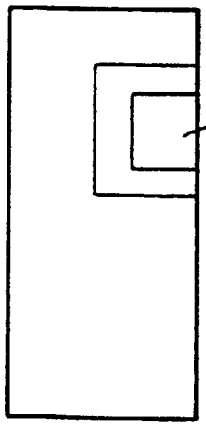
FIG. 12D
PRIOR ART
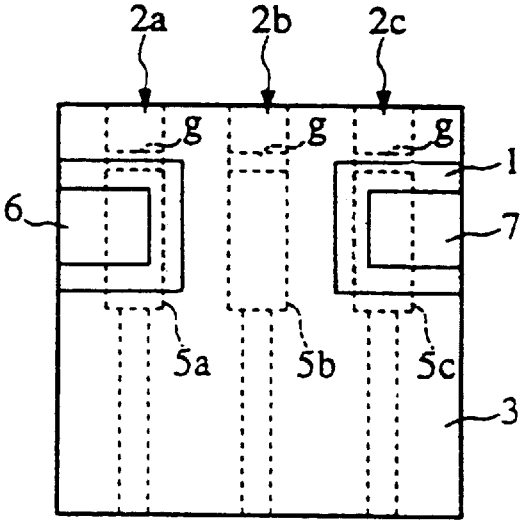
FIG. 12B
PRIOR ART
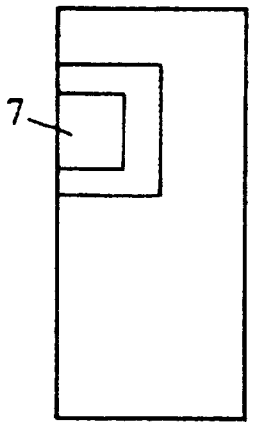
FIG. 12E
PRIOR ART
FIG. 12C
PRIOR ART
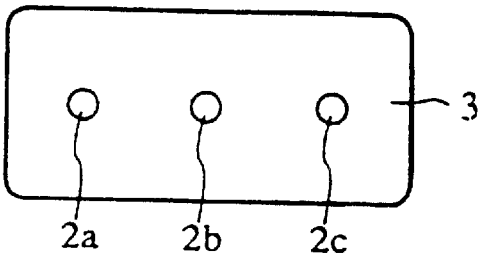

DIELECTRIC FILTER, COMPOSITE DIELECTRIC FILTER, ANTENNA DUPLEXER, AND COMMUNICATION APPARATUS

BACKGROUND OF THE INVENTION

1. Field of the Invention

The present invention relates to a dielectric filter, a composite dielectric filter, a antenna duplexer, and a communication apparatus incorporating the same, used in high-frequency bands.

2. Description of the Related Art

FIGS. 12A, 12B, 12C, 12D and 12E show a structure of a prior art dielectric filter using a dielectric block mainly used in the microwave band. In this figure, FIG. 12B is a front view in which the dielectric filter is vertically stood, FIG. 12(A) is the upper-surface view, FIG. 12C is the bottom view, FIG. 12D is the left-side view, and FIG. 12E is the right-side view. In this figure, the dielectric block is indicated by 1. Inside the dielectric block 1, resonance-line holes indicated by 2*a,* 2*b,* and 2*c* are disposed, and on the inner surface of the holes, an inner conductor is disposed to form resonance lines 5*a,* 5*b,* and 5*c.* On an outer surface of the dielectric block 1, a ground electrode 3 is formed, and external terminals 6 and 7 separated from the ground electrode 3 are disposed at predetermined positions. The external terminal 6 and the resonance line 5*a* make a capacitive coupling, whereas the external terminal 7 and the resonance line 5*c* make a capacitive coupling. In this way, a dielectric filter having a pass-band characteristic of three-stage resonators is formed.

However, in the prior art dielectric filter shown in FIGS. 12A to 12E, the external terminals 6 and 7 perform the input and output of signals in a imbalanced type, in which the respective ground electrodes being used as reference potentials. Therefore, in order to give signals to an amplification circuit of a balance input type for example, it is necessary to convert the signals of imbalance type to those of balance type by using a balun (an imbalance-balance converter). As a result, the filter occupies a large area portion on a circuit board, which being one factor hampering miniaturization.

SUMMARY OF THE INVENTION

To overcome the above described problems, preferred embodiments of the present invention provide a dielectric filter and a composite dielectric filter, in which input and output of signals can be performed in a two-terminal type or a balance type without using the balun, and a communication apparatus including the same.

One preferred embodiment of the present invention provides a dielectric filter, comprising: a plurality of resonance lines aligned in a dielectric block, in a dielectric substrate, or on a dielectric substrate; a plurality of input-output units respectively coupled to the plurality of resonance lines; at least one of the input-output units comprising a first external terminal capacitively coupled to one of the plurality of resonance lines, an external coupling line coupled to the one of the plurality of resonance lines to which the first external terminal is capacitively coupled, and a second external extending from an end of the external coupling line.

The above described dielectric filter can perform input and output of signals by using two terminals, which are not of the same phase.

In the above described dielectric filter, the phase difference between the signals of the first and second external terminals viewed from the one of the plurality of resonance lines to which the first external terminal is capacitively coupled may be substantially 180°. By this arrangement, the input and output of signals of balance type becomes possible.

Another preferred embodiment of the present invention provides a composite dielectric filter comprising a plurality of filters, wherein at least one of the plurality of filters are the above described dielectric filter; and a resonator comprising the resonance line is coupled between the one of the plurality of input-output units and the others of the plurality of input-output units.

Yet another preferred embodiment of the present invention provides an antenna duplexer comprising the composite dielectric filter of claim 3, wherein the plurality of input-output units comprise a transmission signal input terminal, a reception signal output terminal, and an antenna terminal; and the plurality of filters include a transmission filter provided between the transmission signal input terminal and the antenna terminal, and a reception filter provided between the reception signal output terminal and the antenna terminal.

According to the above described composite dielectric filter, the plurality of filters are provided inside the single dielectric block, inside the single dielectric substrate, or on the single dielectric substrate. Further, a balun is not needed to be additionally disposed. Accordingly, the overall device can be further miniaturized. For instance, a transmission signal input terminal, a reception signal output terminal, and an antenna terminal are provided as the plurality of input-output units, a transmission filter is provided between the transmission signal input terminal and the antenna terminal, and a reception filter is provided between the reception signal output terminal and the antenna terminal to constitute an antenna duplexer.

Furthermore, a communication apparatus may be obtained by providing the above described dielectric filter or composite filter in a high-frequency circuit section. According to this arrangement, a compact and lightweight communication apparatus can be obtained.

Other features and advantages of the present invention will become apparent from the following description of the invention which refers to the accompanying drawings.

BRIEF DESCRIPTION OF DRAWINGS

FIGS. 12A, 12B, 12C, 12D and 12E are projection views of a prior art dielectric filter.

DESCRIPTION OF THE PREFERRED EMBODIMENTS

Figure 1A:
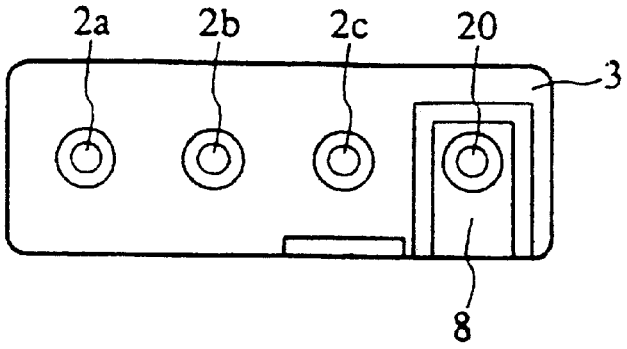
FIGS. 1A, 1B, 1C and 1D are projection views of a dielectric filter according to a first preferred embodiment of the present invention.
Figure 1B:
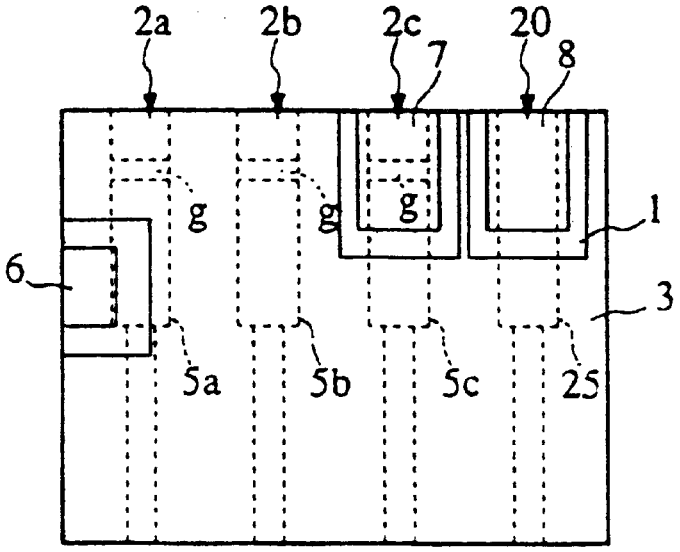
Figure 1D:
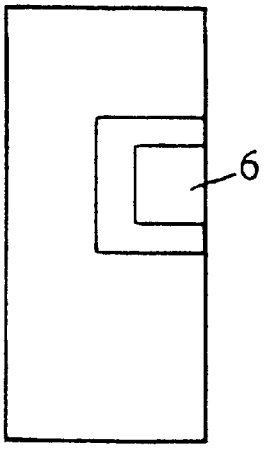
Figure 1C:
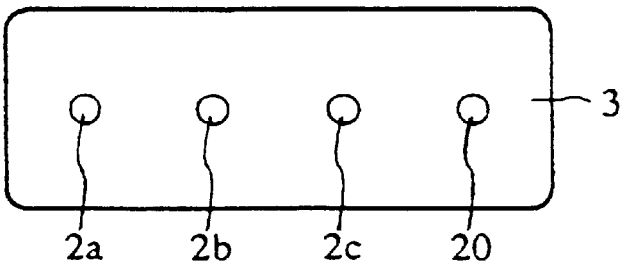

Referring to FIGS. 1A, 1B, 1C, 1D and 2, a description will be given of a structure of a dielectric filter according to a first preferred embodiment of the present invention.

FIGS. 1A, 1B, 1C and 1D are projection view of the dielectric filter, in which 1A is the upper-surface view, 1B is the front view, 1C Is the bottom view, and 1D is the left-side view. The front side shown in this figure is the mounted surface with respect to a circuit board.

This dielectric filter comprises a rectangular parallelepiped dielectric block 1. In the dielectric block 1, holes and electrodes respectively having specified configurations are provided. The reference numerals 2*a,* 2*b,* and 2*c* indicate resonance-line holes, and on the inner surfaces of the resonance-line holes, resonance lines 5*a,* 5*b,* and 5*c* are respectively provided. An external coupling line hole is indicated by 20, and on the inner surface of the coupling line hole, an external coupling line 25 is provided. The resonance-line holes 2*a* through 2*c* and the external coupling line hole 20 are step holes, in which the inner diameters of the upper-half part and the lower-half part are different. Each resonance line has an nonconductive portion indicated by g in the proximity of an end of the large-diameter side of the step hole so as to use this part as an open-circuit end. On an outer surface of the dielectric block 1, an external terminal 8 continuing from one end of the external coupling line 25, external terminals 6 and 7 forming capacitance between these terminals and the resonance lines 5*a* and 5*c,* respectively, are provided. Whereas a ground electrode 3 is provided on the substantially entire surface (six faces) except for these external-terminal parts.

With this arrangement, the resonance lines 5*a,* 5*b,* and 5*c* sequentially make comb-line couplings, and the external terminals 6 and 7 make capacitive couplings (hereinafter referred to as 'C coupling') to the resonance lines 5*a* and 5*c,* respectively. Meanwhile, the external coupling line 25 and the resonance line 5*c* make a comb-line coupling so that output of signals is performed from the external terminal 8 in an inductive coupling (hereinafter referred to as 'L coupling'). The external coupling line 25 does not serve as a resonator for determining the band pass characteristics of the filter, and it is used as an external coupling line. Thus, this dielectric filter serves as a filter circuit in which resonators of three stages are allowed to make the coupling in sequence.

Figure 2:
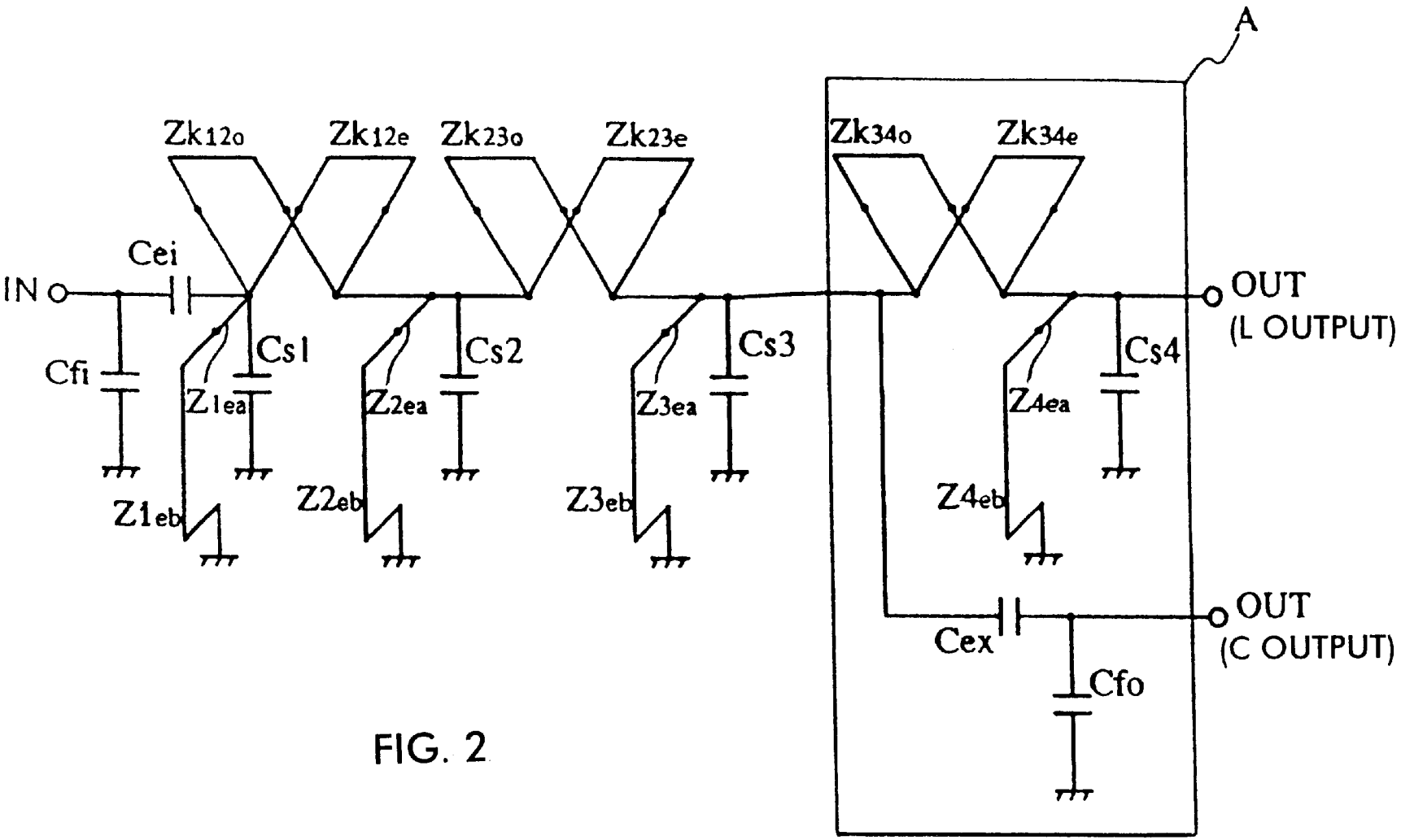
FIG. 2 is an equivalent circuit diagram of the dielectric filter.

FIG. 2 is an equivalent circuit diagram of the dielectric filter shown in FIG. 1. In this case, Z1ea and Z1eb are impedance of the resonance line 5*a.* One resonance line is indicated by two lines on the equivalent circuit, since the resonance line holes are step holes and impedance is different depending on the inner diameter of each step hole. Similarly, Z2ea and Z2eb are impedance of the resonance line 5*b,* and Z3ea and Z3eb are impedance of the resonance line 5*c.* Additionally, Z4ea and Z4eb indicate impedance of the external coupling line 25. Cs1, Cs2, and Cs3 indicate capacitance generated at the nonconductive portions g of the resonance lines 5*a,* 5*b,* and 5*c.* In addition, Cs4 indicates a capacitance between the external terminal 8 and the ground electrode 3. $Zk_{12o}$ indicates the characteristic impedance of an odd mode making the comb-line coupling between the resonance lines 5*a* and 5*b,* and $Zk_{12e}$ indicates the characteristic impedance of an even mode of the same. $Zk_{23o}$ indicates the characteristic impedance of an odd mode between the resonance lines 5*b* and 5*c,* and $Zk_{23e}$ indicates the characteristic impedance of an even mode of the same. Similarly, $Zk_{34o}$ indicates the characteristic impedance of an odd mode between the resonance lines 5*c* and the external coupling line 25, and $Zk_{34e}$ indicates the characteristic impedance of an even mode of the same. Cfi indicates the capacitance between the external terminal 6 and the ground electrode 3, Cei indicates the capacitance between the external terminal 6 and the resonance line 5*a,* Cfo indicates the capacitance between the external terminal 7 and the ground electrode 3, and Cex indicates the capacitance between the external terminal 7 and the resonance line 5*c.*

The part indicated by A in FIG. 2 forms an imbalance-balance conversion circuit. As clearly seen in this equivalent circuit, an OUT terminal on the upper-side in the figure is an output made by the L coupling, whereas an OUT terminal on the lower-side is an output made by the C coupling. Therefore, the phase difference between both output signals can set to be 180° by setting the value of each device forming the above conversion circuit appropriately.

In the above description, although the external terminal 6 is used as an imbalance-input terminal, and the external terminals 7 and 8 are used as balance-output terminals, it is possible to use the external terminal 6 as an imbalance-output terminal and to use the external terminals 7 and 8 as balance-input terminals.

Figure 3A:
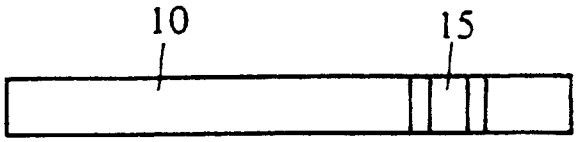
FIGS. 3A, 3B, 3C, 3D and 3E are projection views of a dielectric filter according to a second preferred embodiment.
Figure 3D:
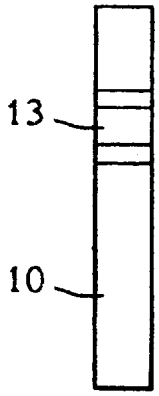
Figure 3B:
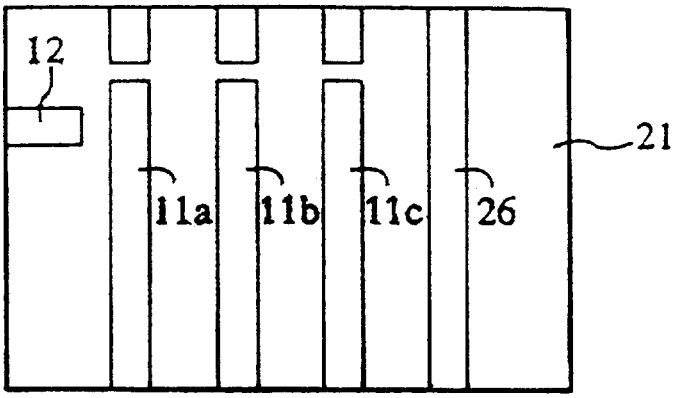
Figure 3C:
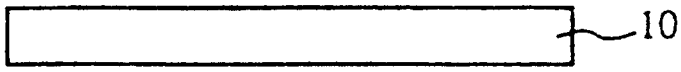
Figure 3E:
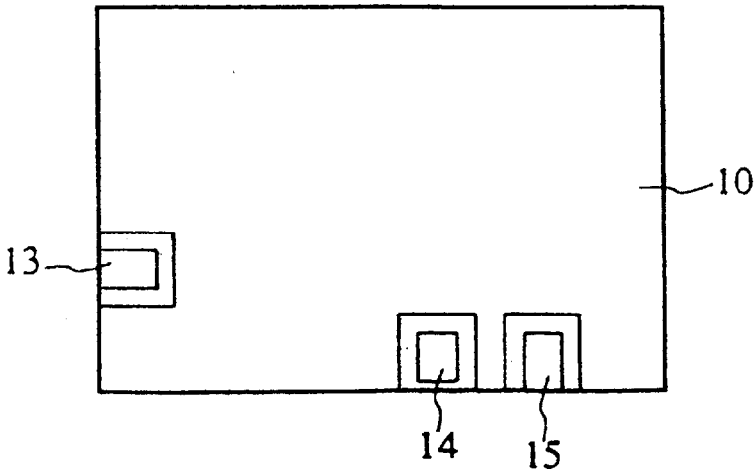
Figure 4A:
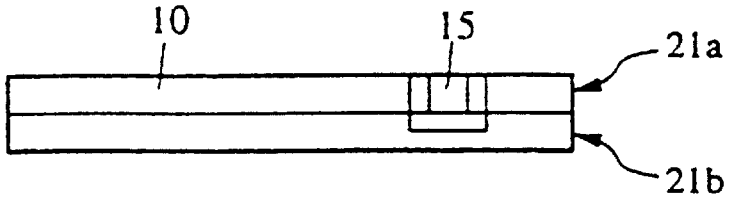
FIGS. 4A, 4B, 4C, 4D and 4E are projection views of a dielectric filter according to a third preferred embodiment.
Figure 4D:
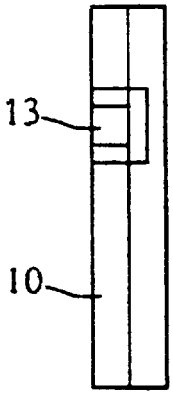
Figure 4B:
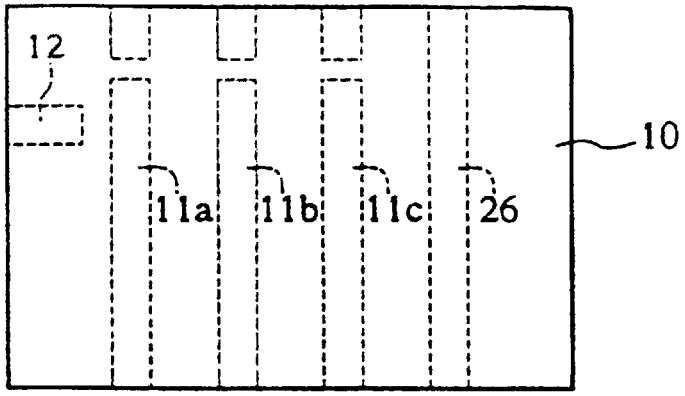
Figure 4C:
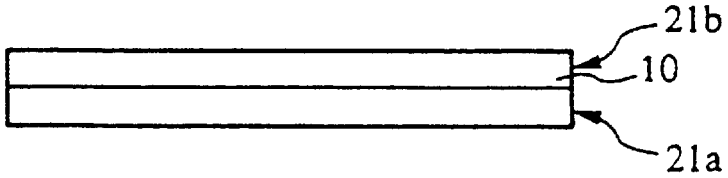
Figure 4E:
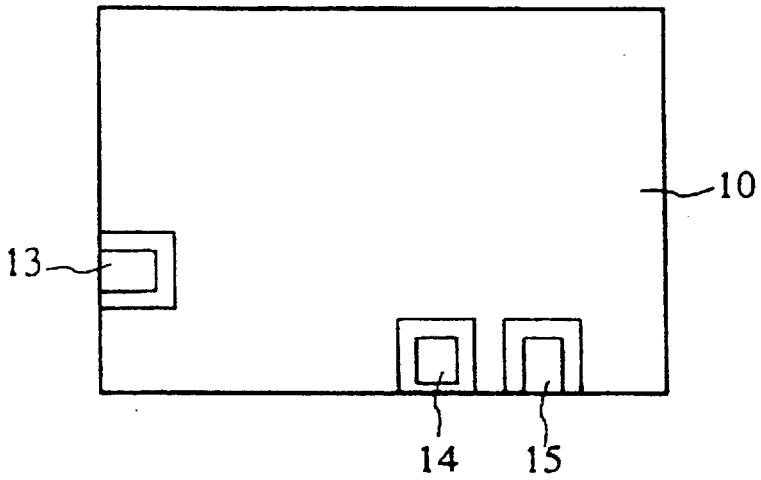
Figure 5A:
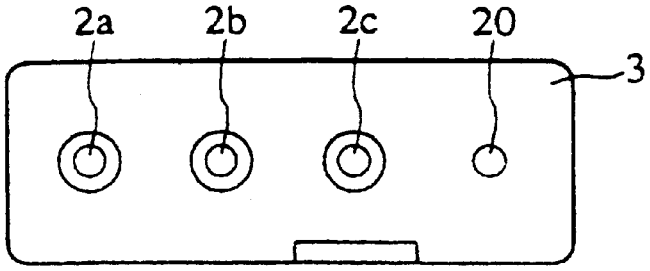
FIGS. 5A, 5B, 5C and 5D are projection views of a dielectric filter according to a fourth preferred embodiment.
Figure 5D:
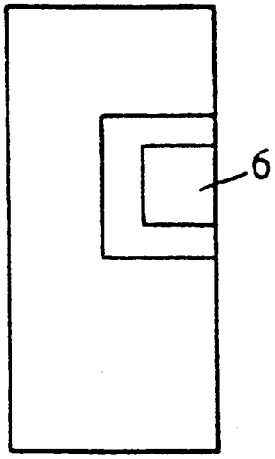
Figure 5B:
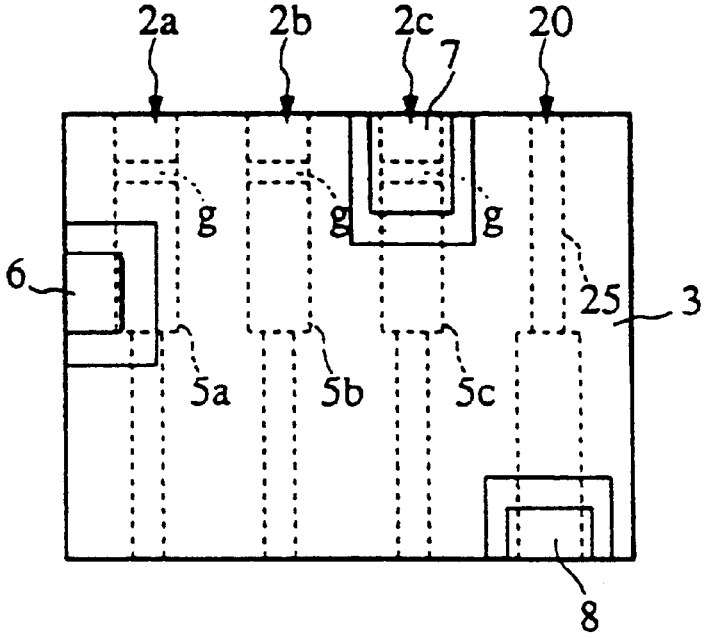
Figure 5C:
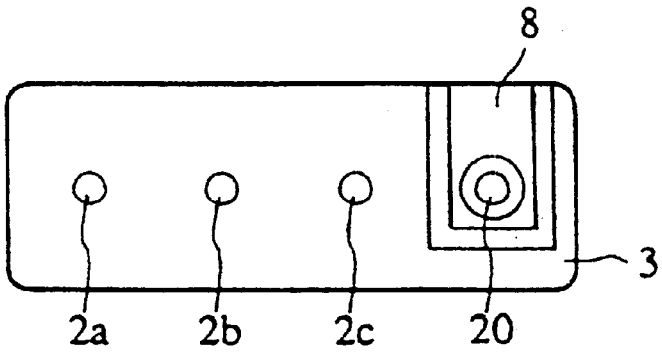

Referring to FIGS. 3A, 3B, 3C, 3D and 3E, a description will be given of a structure of the dielectric filter according to a second preferred embodiment. In this FIG. 3A is the upper-surface view, 3B is the front view, 3C is the bottom view, 3D is the left-side view, and 3E is the back-side view. The back side shown in this figure refers to the mounted surface with respect to the circuit board.

In these figures, 21 indicates a dielectric substrate, on which resonance lines 11*a,* 11*b,* and 11*c,* and an external coupling line 26 are provided. At specified positions of the resonance lines 11*a,* 11*b,* and 11*c* among these resonance lines, electrodeless gaps are formed as open ends. A coupling electrode 12 is provided on the upper surface of the dielectric substrate 21. An external terminal 15 is provided from the front surface of the dielectric substrate 21 to the back surface through the upper surface. In addition, an external terminal 13 is provided from the front surface of the dielectric substrate 21 to the back surface through the left-side surface. Furthermore, an external terminal 14 is provided on the back surface of the dielectric substrate 21. A ground electrode 10 is provided on the almost entire surface except for the parts near these external terminals on an outer surface of the dielectric substrate.

The resonance lines 11*a,* 11*b,* and 11*c* respectively make the comb-line coupling. The coupling electrode 12 and the resonance line 11*a* make a capacitive coupling, and the external terminal 14 and the resonance line 11*c* make a capacitive coupling. In addition, the resonance line 11*c* and the external coupling line 26 make a comb-line coupling. As a result, the structure as an equivalent circuit is basically the same as that shown in FIG. 2, so that a dielectric filter using the external terminal 13 as an imbalance input terminal and using the external terminals 14 and 15 as balance output terminals can be formed.

FIGS. 4A, 4B, 4C, 4D and 4E are projection views of a dielectric filter according to a third preferred embodiment of the present invention. In this case, the dielectric filter of the structure shown in FIG. 3 is formed into a triplet type. That is, there are two dielectric substrates 21*a* and 21*b,* in which the resonance lines 11*a* through 11*c,* the external coupling line 26, and the coupling electrode 12, which are the same as those shown in FIGS. 3A, 3B, 3C, 3D and 3E, are provided on the dielectric substrate 21*a,* whereas resonance lines, an external coupling line, and a coupling electrode, which are in the relationship of mirror-symmetric images with respect to the resonance lines, the external coupling line, and the coupling electrode, are provided on the other dielectric substrate 21*b,* in which the resonance lines and the coupling electrodes formed on both dielectric substrates are bonded together. In this structure, since each resonance line is enclosed by a ground electrode 10, no electromagnetic-field leakage to the outside and no electromagnetic-field coupling to the external circuit occur, so that a dielectric filter having stable characteristics can be obtained.

Referring to FIGS. 5A, 5B, 5C 5D and 6, a structure of a dielectric filter according to a fourth preferred embodiment will be illustrated.

Figure 6:
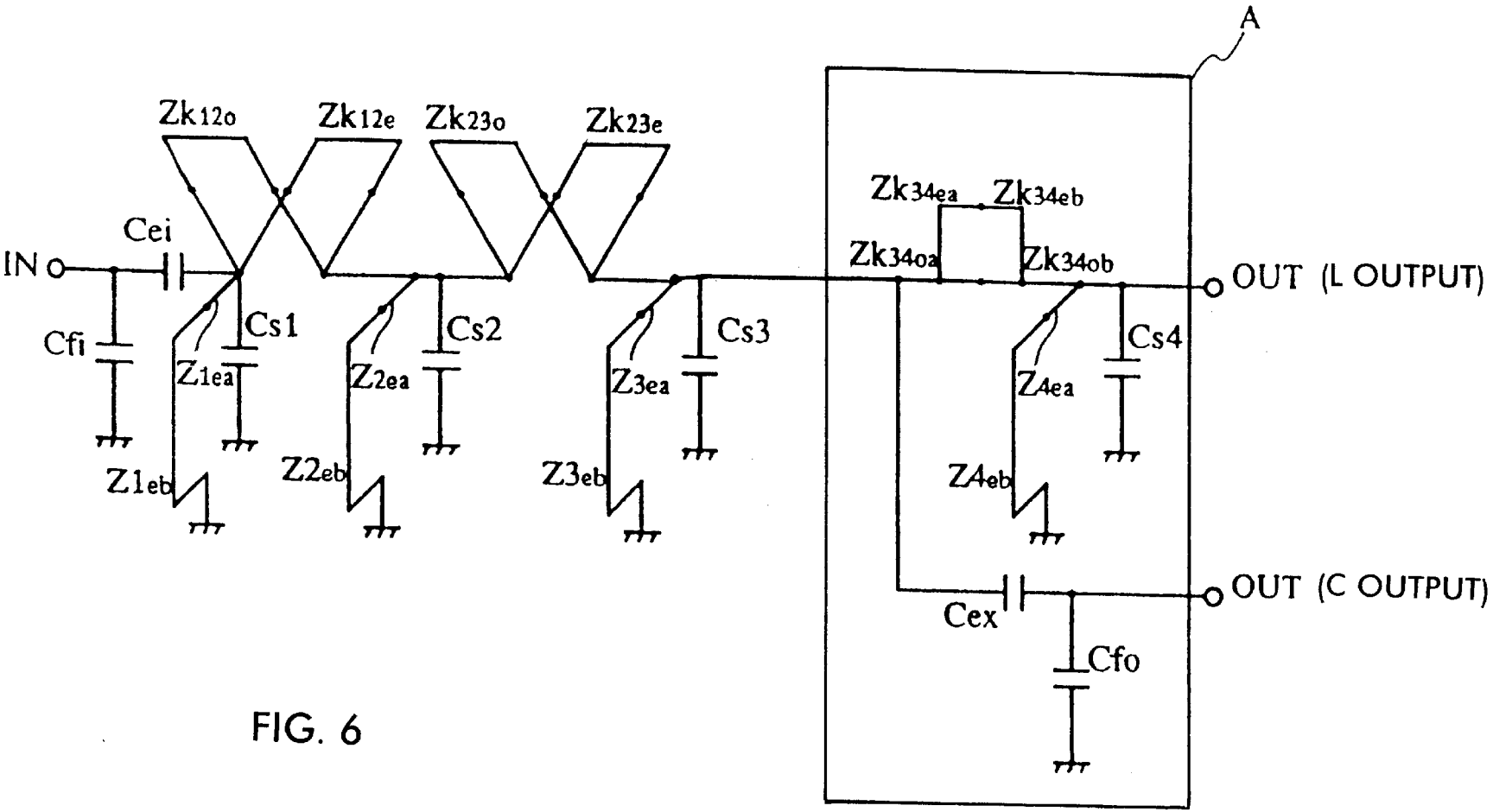
FIG. 6 is an equivalent circuit diagram of the dielectric filter.

In this dielectric filter, the position of the external terminal 8 of the dielectric filter shown in FIGS. 1A through 1D is set to be different. That is, the external terminal 8 is provided on the side, which is opposing the side on which the nonconductive portion g of the resonance line is present. This arrangement permits the resonance line 5*c* and the external coupling line 25 to make an interdigital coupling. The other arrangements are basically the same as those shown in FIG. 1. The equivalent circuit of this dielectric filter is the one shown in FIG. 6. The resonance line 5*c* and the external coupling line 25 make the interdigital coupling, so that the coupling is made in the manner different from that shown in FIG. 2. In FIG. 6, $Zk_{34oa}$, $Zk_{34ea}$, $Zk_{34ob}$, and $Zk_{34eb}$, indicate the characteristic impedance generated at the part in which the external coupling line 25 provided on the external-coupling line hole having a step and the resonance line 5*c* make the interdigital coupling. In this way, the dielectric filter, in which the external terminals 7 and 8 shown in FIG. 5 are used as balance-input terminals, can be obtained.

Figure 7A:
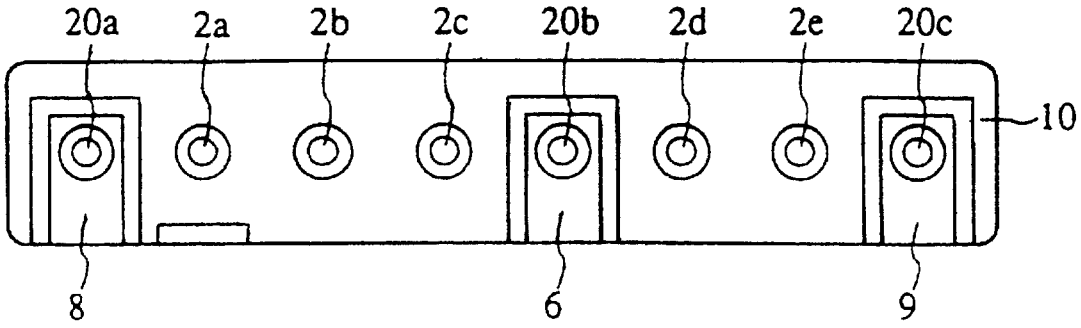
FIGS. 7A, 7B and 7C are projection views of a dielectric filter according to a fifth preferred embodiment.
Figure 7B:
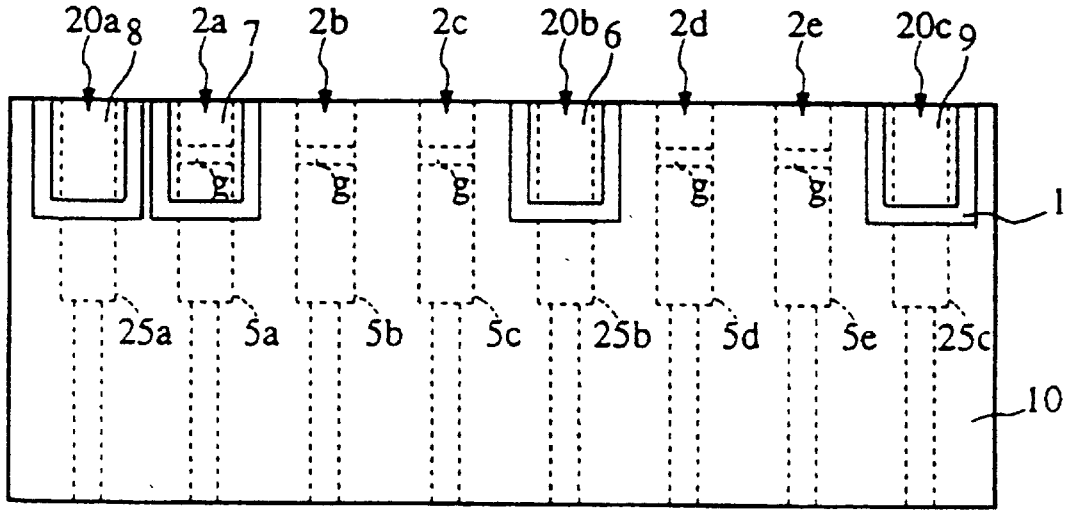
Figure 7C:
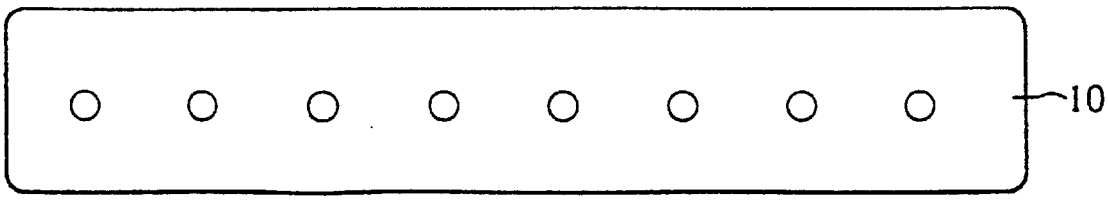
Figure 8A:
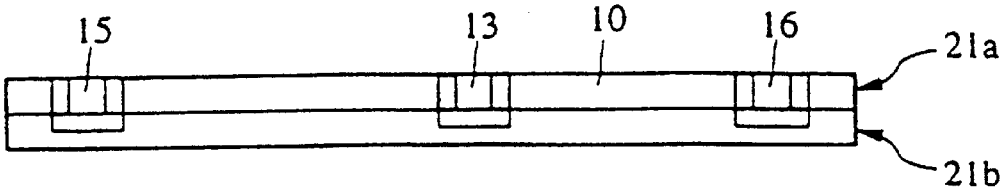
FIGS. 8A, 8B, 8C and 8D are projection views of a dielectric filter according to a sixth preferred embodiment.
Figure 8B:
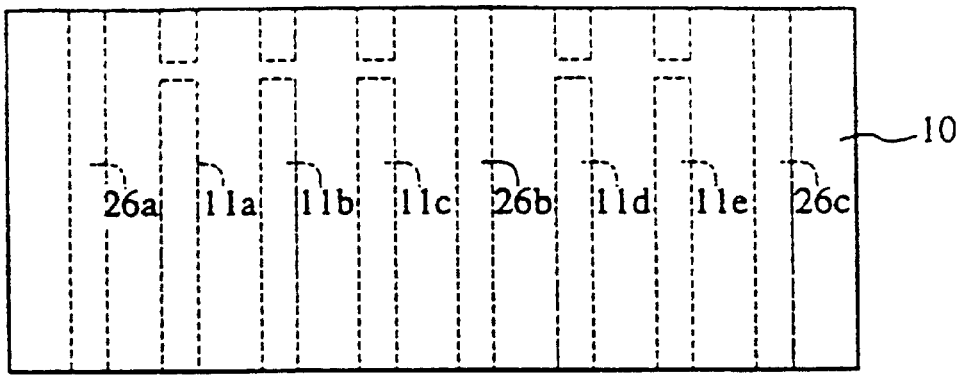
Figure 8C:
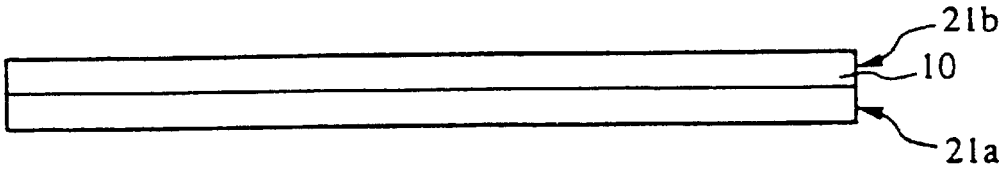
Figure 8D:
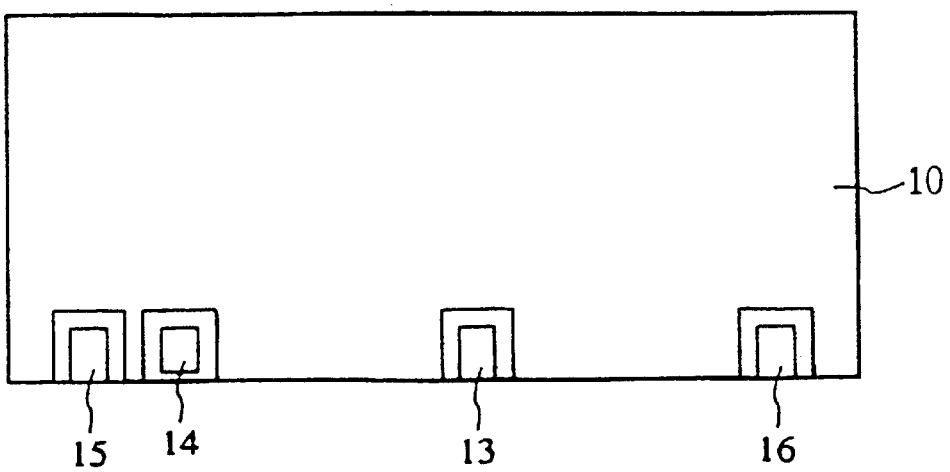

Next, a structure of a duplexer (an antenna duplexer) according to a fifth preferred embodiment will be illustrated referring to FIGS. 7A, 7B and 7C, in which 7A is figure is the upper-side view, 7B is the front view, and 7C is the bottom view. The front side shown in these figures is equivalent to the mounted surface with respect to the circuit board.

2*a,* 2*b,* 2*c,* 2*d,* and 2*e* indicate resonance-line holes, and on the inner surfaces of the resonance-line holes are provided resonance lines 5*a,* 5*b* , 5*c,* 5*d,* and 5*e,* respectively. 20*a,* 20*b,* and 20*c* indicate external coupling line holes, on the inner surfaces of which are provided external coupling lines 25*a,* 25*b,* and 25*c,* respectively. These resonance-line holes 2*a* through 2*e* and these external-coupling line holes 20*a,* 20*b,* and 20*c* are step holes, in which the inner diameter is different in the upper-half part and the lower-half part, respectively, as shown in the figures. On each resonance line, the nonconductive portion indicated by g is disposed near the end on the large inner-diameter side of the step hole so as to use this part as an open end. On an outer surface of the dielectric block 1, the external terminals 8, 6, and 9 respectively continuing from one end of the external-coupling lines 25*a,* 25*b,* and 25*c,* and the external terminal 7 making capacitance between the external terminal and the resonance line 5*a,* are provided. A ground electrode 10 is provided on the almost entire surface (6 faces) except for these external terminal portions.

The operation of a duplexer shown in FIG. 7 will be described as follows: First, the resonance lines 5*a,* 5*b,* and 5*c* sequentially make a comb-line coupling, whereas the resonance line 5*a* and the external terminal 7 make a capacitive coupling. In addition, the resonance line 5*a* and the external coupling line 25*a* make a comb-line coupling, whereas the resonance line 5*c* and the external coupling line 25*b* make a comb-line coupling. In this arrangement, the external terminals 7 and 8 serve as balance-output terminals, whereby a filter formed of resonators of three stages, which has a band pass characteristic, is formed between the external terminal 6, 7 and 8. Furthermore, the external coupling line 25*b,* the resonance lines 5*d* and 5*e,* and the external coupling line 25*c* sequentially make a comb-line coupling. This permits a filter formed of two-stage resonators, which has a band pass characteristic, to be formed between the external terminals 6 and 9. In this case, the former filter is used as a reception filter, whereas the latter filter is used as a transmission filter, in which the external terminal 9 is used as an input terminal of transmission signals, external terminals 7 and 8 are used as output terminals of reception signals, and the external terminal 6 is used as an antenna connection terminal.

A structure of a duplexer according to a sixth preferred embodiment will be illustrated referring to FIGS. 8A, 8B, 8C and 8D. In these figures, 8A is the upper-side view, 8B is the front view, 8C is the bottom view, 8D is the back view. The back side in these figures are the mounted surface with respect to the circuit board.

In these figures, 21*a* and 21*b* are dielectric substrates. On the upper surface of the dielectric substrate 21*a* are provided resonance lines 11*a* through 11*e* and external coupling lines 25*a,* 26*b,* and 26*c,* respectively. At specified places on these resonance lines 11*a* through 11*e,* electrodeless gaps are provided as open ends. In addition, from the upper surface of the dielectric substrate 21*a* to the back surface of the same, external terminals 15, 13, and 16, which are extending from the external coupling lines 25*a,* 26*b,* and 26*c,* are respectively provided. A ground electrode 10 is provided on the substantially entire outer surface of the dielectric substrate, except for the area near these external terminals. Furthermore, an external terminal 14 is provided on the back side of the dielectric substrate 21*a*.

The operation of the duplexer shown in FIGS. 8A through 8D is described as follows: First, the resonance lines 11*a,* 11*b,* and 11*c* sequentially make the comb-line coupling, and the resonance line 11*a* and the external terminal 14 make the capacitive coupling. In addition, the resonance line 11*a* and the external coupling line 26*a* make the comb-line coupling, and the resonance line 11*c* and the external coupling line 26*b* make the comb-line coupling. In this arrangement, the external terminals 14 and 15 serve as balance-output terminals, in which a filter formed of resonators of three stages, which has a band pass characteristic, is formed between the external terminals 13, 14, and 15. Furthermore, the external coupling line 26*b,* the resonance lines 11*d* and 11*e,* and the external coupling line 26*c* sequentially make comb-line couplings. In this arrangement, a filter formed of two resonators, which has a band pass characteristic, is formed between the external terminals 13 and 16. In this case, the former filter is used as a reception filter, and the latter filter is used as a transmission filter. Furthermore, the external terminal 16 is used as an input terminal of transmission signals, the external terminals 14 and 15 are used as output terminals of reception signals, and the external terminal is used as an antenna connection terminal.

Figure 9A:
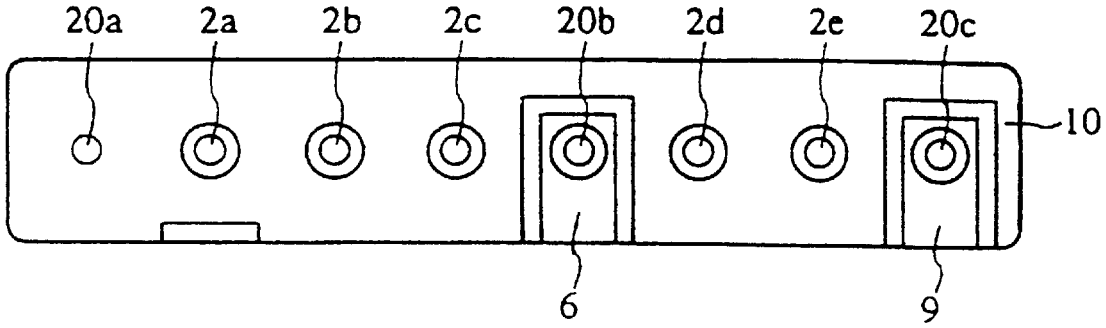
FIGS. 9A, 9B and 9C are projection views of a dielectric filter according to a seventh preferred embodiment.
Figure 9B:
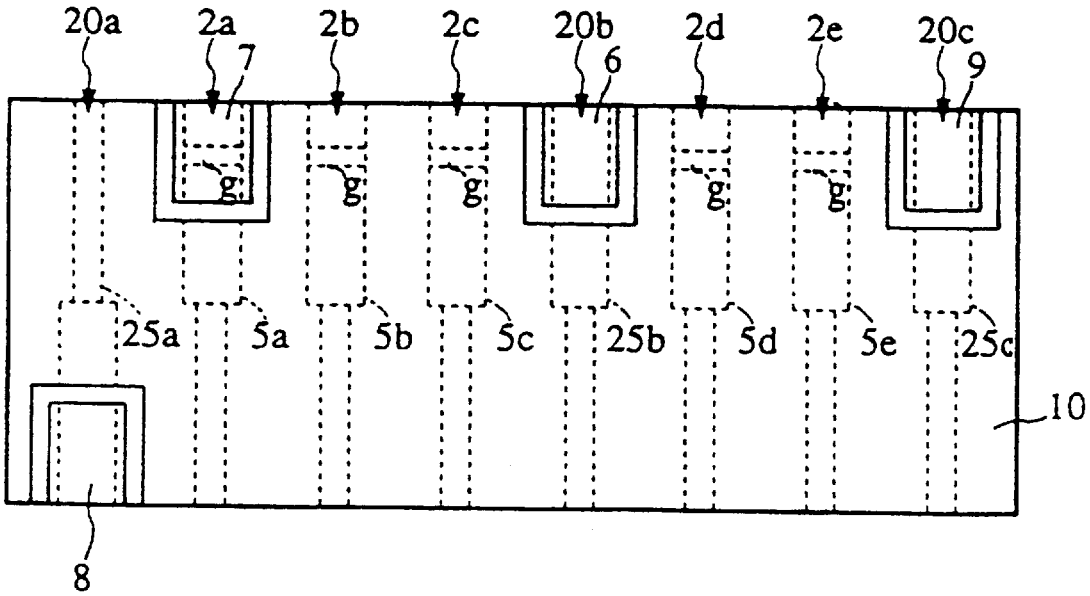
Figure 9C:
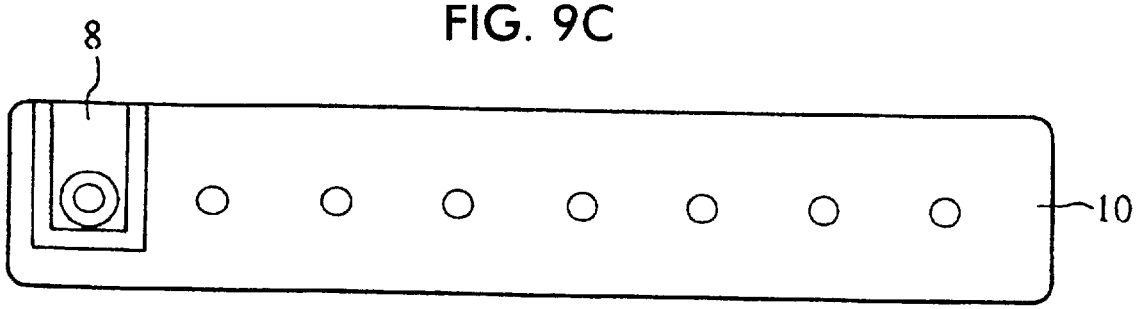

A structure of a duplexer according to a seventh preferred embodiment will be illustrated referring to FIGS. 9A, 9B and 9C, in which 9A is the upper-side view, 9B is the front view, and 9C is the bottom view. In the duplexer shown in this embodiment, which is different from the one shown in FIGS. 7A through 7C, one of the balance-output terminals is taken out by the interdigital coupling. That is, the external terminal 8 is disposed on the bottom surface shown in the figure of the dielectric block, and the resonance line 5*a* and the external coupling line 25*a* make the interdigital coupling. Additionally, the external coupling line hole 20*a* is a step hole, in which the inner diameter on the bottom side in the figure of the dielectric block is made to be large. The other arrangements are substantially the same as those shown in FIGS. 7A through 7C.

Figure 10:
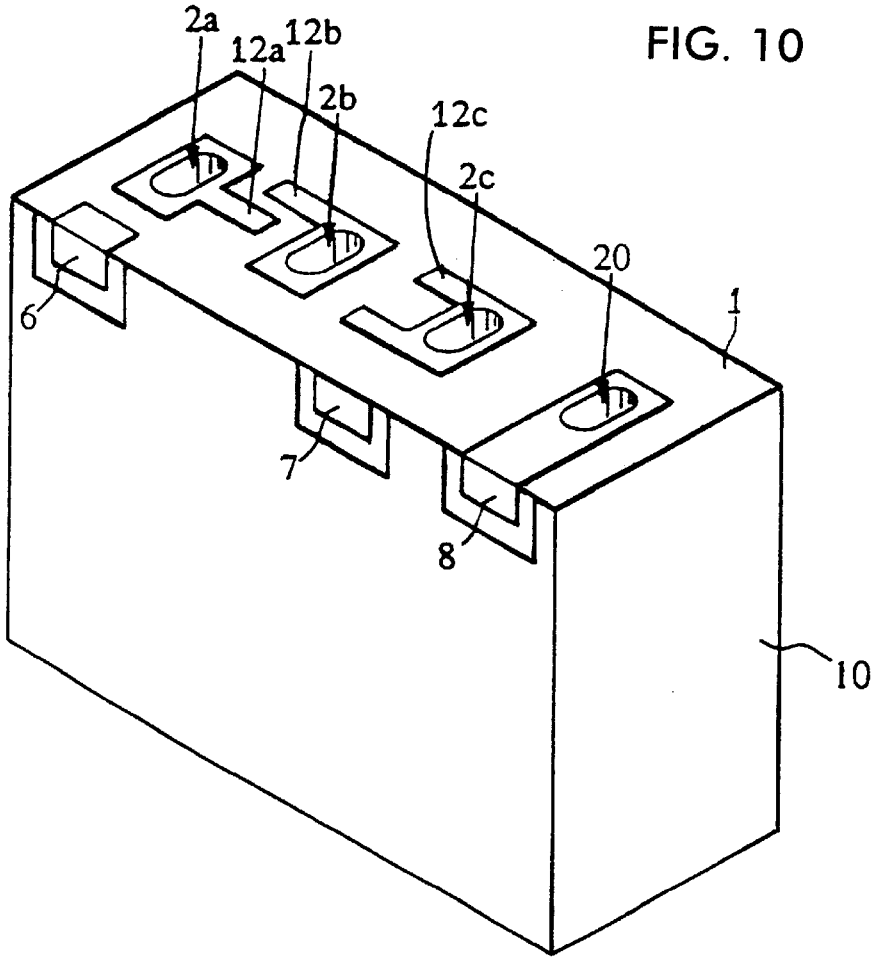
FIG. 10 is a projection view of a dielectric filter according to an eighth preferred embodiment.

Next, a structure of the dielectric filter according to an eighth preferred embodiment will be illustrated referring to FIG. 10. In the dielectric filter described above, although the resonance lines are provided inside the dielectric block, inside the dielectric substrate, or on the dielectric substrate, and an nonconductive portion is disposed on a part on the respective resonance lines, the open-circuited ends of the resonance lines may be disposed on an outer surface of the dielectric block or the dielectric substrate.

In FIG. 10, 1 indicates a dielectric block. Resonance line holes 2*a,* 2*b,* and 2*c,* which pass through mutually in parallel, and an external-coupling line hole 20, are disposed, in which on the inner surface thereof, an inner conductor is formed to dispose a resonance line. These resonance line holes 2*a* through 2*c* and the external-coupling line hole 20 are straight holes having an oval section and a uniform inner diameter. A ground electrode 10 is provided on the substantially entire surface including the bottom and the four sides in the figure of the dielectric block 1. The resonance lines formed on the inner surfaces of the resonance-line holes 2*a* through 2*c* and the external-coupling line formed on the inner surface of the external-coupling line hole 20 are continued to the ground electrode 10 on the bottom surface of the dielectric block 1 shown in the figure. On the upper surface shown in the figure of the dielectric block 1, the coupling electrodes 12*a,* 12*b,* and 12*c* extending from the resonance lines are disposed to make a capacitive coupling between the adjacent resonance lines. Furthermore, on the upper surface and the side surface of the left front shown in the figure of the dielectric block 1, the external terminals 6, 7, and 8 are provided. The external terminals 6 and 7 and the resonance lines provided on the resonance-line holes 2*a* and 2*c* make a capacitive coupling. The external terminal 8 extends directly from an end of the external-coupling line hole 20.

In the structure shown in FIG. 10, the external terminal 6 is used as an imbalance-input-output terminal, and the external terminals 7 and 8 are used as balance-input-output terminals.

As another modification of the coupling between the resonance lines, for example, a structure in which a coupling hole having a specified depth is disposed at a midpoint between the adjacent resonance-line holes so as to make a coupling by providing a difference between the frequency of an even mode and that of an odd mode.

Figure 11:
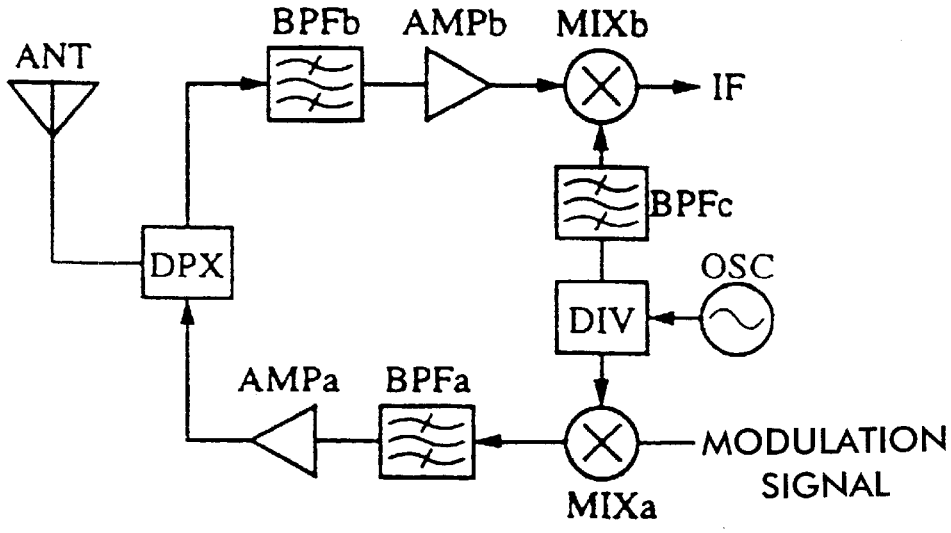
FIG. 11 is a block diagram showing a structure of a communication apparatus according to the present invention.

Referring to FIG. 11, a description will be given of a structure of a communication apparatus including the dielectric filter or the duplexer described above. In this figure, ANT is a transmission-reception antenna, DPX is a duplexer, BPFa, BPFb, and BPFc are band pass filters, AMPa and AMPb are amplification circuits, MIXa and MIXb are mixers, OSC is an oscillator, and DIV is a frequency divider (a synthesizer). MIXa modulates frequency signals output from DIV by modulation signals, BPFa passes only signals of the band of the transmission frequency, and AMPa performs a power-amplification of the signals to transmit from ANT through DPX. BPFb passes only signals of the reception-frequency band among the signals output from DPX and AMPb amplifies them. MIXb performs mixing of the frequency signals output from BPFc and the reception signals to output intermediate frequency signals IF.

The duplexer of the structure shown in FIGS. 7A through 9C can be used as the duplexer DPX shown in FIG. 11. Furthermore, as the pass band filters BPFa, BPFb, and BPFc,the dielectric filter of the structure shown in FIGS. 1A through 6 or of the structure shown in FIG. 10, can be used. This arrangement permits an overall compact communication apparatus to be formed.

While the invention has been particularly shown and described with reference to the preferred embodiments thereof, it will be understood by those skilled in the art that the forgoing and other changes in form and details may be made therein without departing from the invention.

What is claimed is:

1. A dielectric filter, comprising:

a plurality of resonance lines aligned in a dielectric block, in a dielectric substrate, or on a dielectric substrate;

a plurality of input-output units respectively coupled to the plurality of resonance lines;

at least one of the input-output units comprising a first external terminal capacitively coupled to one of the plurality of resonance lines, an external coupling line coupled to the one of the plurality of resonance lines to which the first external terminal is capacitively coupled, and a second external terminal extending from an end of the external coupling line;

wherein the phase difference between the signals of the first and second external terminals viewed from the one of the plurality of resonance lines to which the first external terminal is capacitively coupled is substantially 180°, and the first and second external terminals are balance terminals.

2. A composite dielectric filter comprising a plurality of filters, wherein at least one of the plurality of filters comprises a plurality of resonance lines aligned in a dielectric block, in a dielectric substrate, or on a dielectric substrate; a plurality of input-output units respectively coupled to the plurality of resonance lines; at least one of the input-output units comprising a first external terminal capacitively coupled to one of the plurality of resonance lines, an external coupling line coupled to the one of the plurality of resonance lines to which the first external terminal is capacitively coupled, and a second external terminal extending from an end of the external coupling line; and a resonator comprising the resonance line is coupled between the one of the plurality of input-output units and the others of the plurality of input-output units.

3. A composite dielectric filter comprising a plurality of filters, wherein at least one of the plurality of filters are the dielectric filter of claim 1; and a resonator comprising the resonance line is coupled between the one of the plurality of input-output units and the others of the plurality of input-output units.

4. An antenna duplexer comprising the composite dielectric filter of claim 2, wherein the plurality of input-output units comprise a transmission signal input terminal, a reception signal output terminal, and an antenna terminal; and the plurality of filters include a transmission filter provided between the transmission signal input terminal and the antenna terminal, and a reception filter provided between the reception signal output terminal and the antenna terminal.

5. An antenna duplexer comprising the composite dielectric filter of claim 3, wherein the plurality of input-output units comprise a transmission signal input terminal, a reception signal output terminal, and an antenna terminal; and the plurality of filters include a transmission filter provided between the transmission signal input terminal and the antenna terminal, and a reception filter provided between the reception signal output terminal and the antenna terminal.

6. A communication apparatus, comprising the dielectric filter of claim 1, each of which being provided in a high-frequency circuit section.

7. A communication apparatus, comprising the composite dielectric filter of claim 2, each of which being provided in a high-frequency circuit section.

8. A communication apparatus, comprising the composite dielectric filter of claim 3, each of which being provided in a high-frequency circuit section.

9. A communication apparatus, comprising the antenna duplexer of claim 4, each of which being provided in a high-frequency circuit section.

10. A communication apparatus, comprising the antenna duplexer of claim 5, each of which being provided in a high-frequency circuit section.

* * * * *